US008928451B2

(12) United States Patent
Sim et al.

(10) Patent No.: US 8,928,451 B2
(45) Date of Patent: Jan. 6, 2015

(54) COMMON MODE FILTER AND METHOD OF MANUFACTURING THE SAME

(71) Applicant: Samsung Electro-Mechanics Co., Ltd., Gyeonggi-do (KR)

(72) Inventors: Won Chul Sim, Gyunggi-do (KR); Chan Yoon, Gyunggi-do (KR); Young Seuck Yoo, Gyeonggi-do (KR); Sung Kwon Wi, Gyeonggi-do (KR)

(73) Assignee: Samsung Electro-Mechanics Co., Ltd., Suwon-Si (KR)

( * ) Notice: Subject to any disclaimer, the term of this patent is extended or adjusted under 35 U.S.C. 154(b) by 0 days.

(21) Appl. No.: 14/073,666

(22) Filed: Nov. 6, 2013

(65) Prior Publication Data

US 2014/0125445 A1 May 8, 2014

(30) Foreign Application Priority Data

Nov. 7, 2012 (KR) ..... 10-2012-0125387

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 41/04*** | (2006.01) |
| ***H01F 19/04*** | (2006.01) |

(52) U.S. Cl.

CPC ..... *H01F 17/0013* (2013.01); *H01F 41/041* (2013.01); *H01F 41/046* (2013.01); *H01F 19/04* (2013.01); *H01F 2017/0073* (2013.01)

USPC ..... 336/200; 336/232

(58) Field of Classification Search

USPC ..... 336/200, 232

See application file for complete search history.

(56) References Cited

U.S. PATENT DOCUMENTS

| | | | | |
|---|---|---|---|---|
| 6,097,273 | A * | 8/2000 | Frye et al. | 336/200 |
| 6,838,970 | B2 * | 1/2005 | Basteres et al. | 336/200 |
| 7,307,503 | B2 * | 12/2007 | Kaji et al. | 336/200 |
| 7,508,291 | B2 * | 3/2009 | Matsumoto et al. | 336/200 |

FOREIGN PATENT DOCUMENTS

| | | | |
|---|---|---|---|
| JP | 2000-277354 | A | 10/2000 |
| JP | 2002-110423 | A | 4/2002 |
| JP | 2002-343639 | A | 11/2002 |
| JP | 2005-044834 | A | 2/2005 |
| JP | 2006-024772 | A | 1/2006 |
| JP | 2008-108921 | A | 5/2008 |
| KR | 10-2008-0102993 | A | 11/2008 |
| WO | 2011/114859 | A1 | 9/2011 |

* cited by examiner

*Primary Examiner* — Tsz Chan

(74) *Attorney, Agent, or Firm* — McDermott Will & Emery LLP

(57) ABSTRACT

Disclosed herein are a common mode filter and a method of manufacturing the same. The common mode filter includes: a primary coil that includes a primary coil body forming a plane in a vortex structure; and a secondary coil that includes a secondary coil body forming a co-plane in the same vortex structure as the primary coil body and forms a 180° rotational symmetry with the primary coil body, having the same length, width, and turn number as the primary coil body. Further, the method of manufacturing a common mode filter is proposed.

11 Claims, 6 Drawing Sheets

COMMON MODE FILTER AND METHOD OF MANUFACTURING THE SAME

CROSS REFERENCE(S) TO RELATED APPLICATIONS

This application claims the benefit under 35 U.S.C. Section 119 of Korean Patent Application Serial No. 10-2012-0125387 entitled "Common Mode Filter and Method of Manufacturing the Same" filed on Nov. 7, 2012, which is hereby incorporated by reference in its entirety into this application.

BACKGROUND OF THE INVENTION

1. Technical Field

The present invention relates to a common mode filter and a method of manufacturing the same, and more particularly, to a common mode filter with the electromagnetic degree of coupling by implementing a primary coil and a secondary coil on a co-plane and making a length and a turn number of a coil equal and a method of manufacturing the same.

2. Description of the Related Art

As a demand for high-speed and multi-functional electronic devices increases, the use of an interface for high-speed data transmission has greatly increased. In particular, a high-speed interface based on a differential transmission scheme, for example, circuits, such as USB 2.0, USB 3.0, HDMI, and the like, has increasingly used a filter for removing a common mode noise and the development of a small-sized and high-performance common mode noise filter (CMF) capable of coping with a trend of the use of a high frequency and the miniaturization of components is very urgently required.

In order to improve electrical characteristics of coil components such as a common mode filter (CMF), and the like, it is important to increase the electromagnetic degree of coupling between the primary coil and the secondary coil. In order to increase the electromagnetic degree of coupling between the primary and secondary coils, there is a need to form a magnetic path so as to reduce an interval between two coils or prevent a leakage flux from occurring. However, in an SMD type, a terminal unit for mounting is biased to each corner, such that a structure in which an inter-coil matching relationship is not formed appears. In other words, a difference in an inter-terminal distance occurs, such that a difference in an impedance value, a difference in a length of a conducting wire, a difference in a turn number of a magnetic core (a central magnetic path) cannot but occur and terminal impedance of two coils, respectively, cannot be equally formed structurally. Therefore, there is a problem in that an insertion loss may be degraded with the reduced electromagnetic degree of coupling between two coils.

In the related art, an inter-terminal impedance difference is compensated by biasing a starting position of a coil to one side in order to compensate for the inter-coil turn number by using a compensation method. However, even in this case, there is the inter-terminal impedance difference, for example, the impedance difference of a minimum of about 8%. Further, even when the compensation is performed by biasing the central magnetic path (magnetic core) from a center to one side and biasing the coil to one side, the inter-coil impedance difference of a predetermined amount, for example, a minimum of about 5% occurs.

RELATED ART DOCUMENT

Patent Document (Patent Document 1) Japanese Patent Laid-Open Publication No. 2006-024772 (laid-open published on Jan. 26, 2006)

SUMMARY OF THE INVENTION

An object of the present invention is to increase an electromagnetic degree of coupling by forming a primary coil and a secondary coil on a co-plane in parallel, making a length and a turn number of a coil equal, and forming the primary coil and the secondary coil so as to be 180° rotational symmetry with each other, thereby improving an insertion loss characteristic.

Another object of the present invention is to improve the insertion loss characteristic by improving a ratio of an inter-coil distance to a sum of a coil width between patterns and the inter-coil distance.

According to an exemplary embodiment of the present invention, there is provided a common mode filter, including: a primary coil that includes a primary coil body forming a plane in a vortex structure; and a secondary coil that includes a secondary coil body forming a co-plane in the same vortex structure as the primary coil body and forms a 180° rotational symmetry with the primary coil body, having the same length, width, and turn number as the primary coil body.

When an interval between the primary and secondary coil bodies is S and the width of the primary and secondary coil bodies is W, $0.25 \leq S/(W+S) \leq 0.75$.

A basic shape of the vortex structure of the primary and secondary coil bodies may be a shape of a figure having a half structure in which the primary and secondary coil bodies form the 180° rotational symmetry with each other.

The figure in which the half structure forms the 180° rotational symmetry may be any one of an oval, a circle, and a polygon.

The primary coil may be formed on a plane different from the primary coil body and may further include a primary inner connection portion that is connected with a vortex inner end of the primary coil body and a primary outer connection portion that is connected with the other end of the primary coil body, and the secondary coil may be formed on the same plane as the primary inner connection portion and may further include a secondary inner connection portion that is connected with a vortex inner end of the secondary coil body and a secondary outer connection portion that is connected with the other end of the secondary coil body.

The common mode filter may further include: a non-magnetic insulating layer in which the primary and secondary coils are embedded; magnetic layers formed above and under the non-magnetic insulating layer; and a plurality of external electrodes that are formed outside a laminate of the insulating layer and the magnetic layers and connected with the outer and inner connection portions of the primary and secondary coils.

The primary and secondary coils may be laminated in a multilayer structure of at least two layers, the primary and secondary coil bodies may form the 180° rotational symmetry in each layer of the multilayer structure, and the vortex inner ends or the other ends may be each connected between the primary coil bodies and the secondary coil bodies on an upper layer and a lower layer adjacent to each other in the multilayer structure through vias.

The primary coil bodies and the secondary coil bodies on the upper and lower layers adjacent to each other may have upper and lower structures forming a linear symmetry in a plan view, and the second coil body may be formed under the primary coil body on the upper layer and the primary coil body may be formed under the secondary coil body on the upper layer.

The common mode filter may further include: a non-magnetic insulating layer in which the multilayer structure of the primary and secondary coils and the vias are embedded; magnetic layers formed above and under the non-magnetic insulating layer; and a plurality of external electrodes that are formed outside a laminate of the insulating layer and the magnetic layers and are connected with connection portions connected with the rest not connected with the ends of the primary and secondary coil bodies on the adjacent layers among the inner and other ends of the primary and secondary coil bodies formed on an outermost layer in the multilayer structure.

According to another exemplary embodiment of the present invention, there is provided a method of manufacturing a common mode filter, including: forming a primary coil pattern including a primary coil body having a vortex structure and a secondary coil pattern including a secondary coil body having the same vortex structure as the primary coil body and having the same length, width, and turn number as the primary coil body and forming the primary and secondary coil patterns so that the primary and secondary coil patterns form the same plane and has a 180° rotational symmetry with each other.

When an interval between the primary and secondary coil bodies is S and the width of the primary and secondary coil bodies is W, the primary and secondary coil patterns may be formed so as to meet $0.25 \leq S/(W+S) \leq 0.75$.

The method may further include: laminating an upper non-magnetic insulating layer on a lower non-magnetic insulating layer on which the primary and secondary coil patterns are formed and forming inner connection portions connected with the vias connected with the vertex inner ends of the primary and secondary coil bodies by penetrating through the lower or upper non-magnetic insulating layer on the lower or upper non-magnetic insulating layer to form a non-magnetic insulating layer in which the primary and secondary coil patterns are embedded; forming a laminate by laminating a magnetic layer above and under the non-magnetic insulating layer; and forming outer connection portions connected with the other ends of the primary and secondary coil bodies and a plurality of external electrodes connected with the inner connection portions outside the laminate.

The method may further include: forming the primary and secondary coil patterns on a N−1-th layer on a N−1-th non-magnetic insulating layer and then, laminating a N-th non-magnetic insulating layer on the primary and secondary coil patterns, wherein when the N−1 is 2 or more, the vias are connected with the rest ends that are not connected with primary and secondary coil patterns on the other layer and forming a multilayer repeatedly forming an N-th layer N−1 times in which vias connected with ends of the primary and secondary coil patterns on the N−1-th layer by penetrating through the N-th non-magnetic insulating layer and the primary and secondary coil patterns on a N-th-layer connected with ends of the primary and secondary coil patterns on the N−1-th layer through the vias are formed on the N-th non-magnetic insulating layer, when the N is a natural number of 2 or more; laminating a N+1-th non-magnetic insulating layer on the primary and secondary coil patterns on the top N-th layer formed in the forming of the multilayer to form a non-magnetic laminated insulating layer in which the primary and secondary coil patterns having the N-layer structure are embedded; forming a laminate by laminating a magnetic layer above and under the non-magnetic laminated insulating layer, respectively; and forming the plurality of external electrodes connected with connection portions connected with the rest that are not connected with ends of the primary and secondary coil bodies of the adjacent layers among the vortex inner ends and the other ends of the primary and secondary coil bodies formed on an outermost layer having the N-layer structure outside the laminate.

DESCRIPTION OF THE PREFERRED EMBODIMENTS

Figure 1:
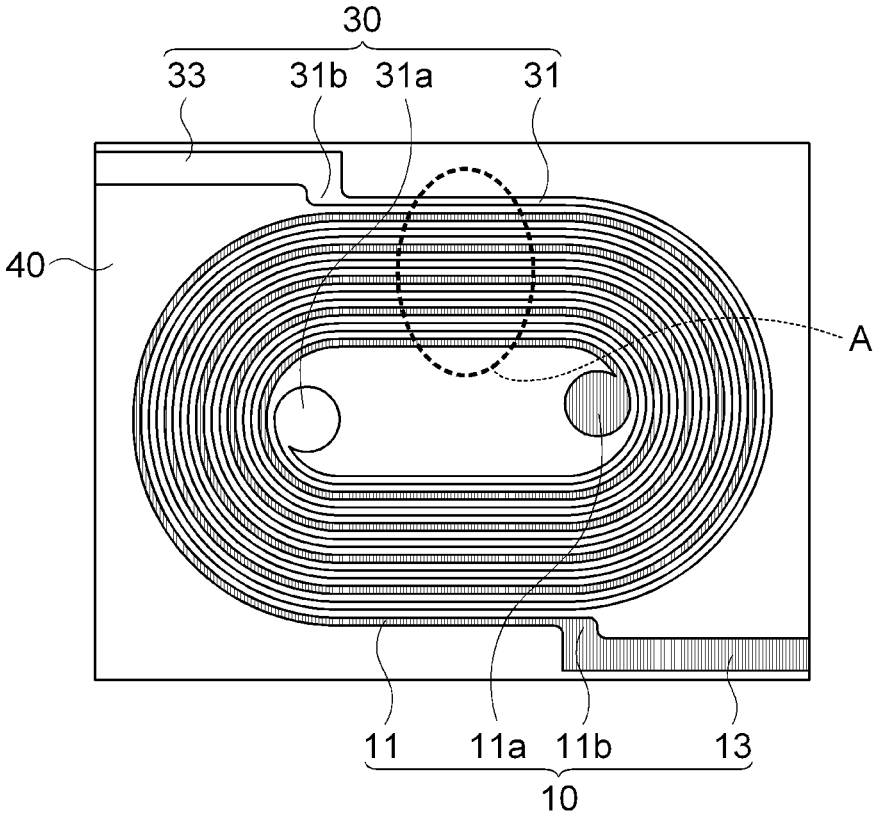
FIG. 1 is a diagram schematically illustrating a common mode filter according to an embodiment of the present invention.

Exemplary embodiments of the present invention for accomplishing the above-mentioned objects will be described with reference to the accompanying drawings. In the present specification, the same reference numerals will be used to describe the same components, and a detailed description thereof will be omitted in order to allow those skilled in the art to easily understand the present invention.

In the specification, it will be understood that unless a term such as 'directly' is not used in a connection, coupling, or disposition relationship between one component and another component, one component may be 'directly connected to', 'directly coupled to' or 'directly disposed to' another element or be connected to, coupled to, or disposed to another element, having the other element intervening therebetween.

Although a singular form is used in the present description, it may include a plural form as long as it is opposite to the concept of the present invention and is not contradictory in view of interpretation or is used as a clearly different meaning. It should be understood that "include", "have", "comprise", "be configured to include", and the like, used in the present description do not exclude presence or addition of one or more other characteristic, component, or a combination thereof.

The accompanying drawings referred in the present description may be ideal or abstract examples for describing exemplary embodiments of the present invention. In the accompanying drawings, a shape, a size, a thickness, and the like, may be exaggerated in order to effectively describe technical characteristics.

First, a common mode filter according to a first exemplary embodiment of the present invention will be described in detail with reference to the accompanying drawings. In this case, reference numerals that are not shown in the accompanying drawings may be reference numerals in other drawings showing the same configuration.

Figure 2:
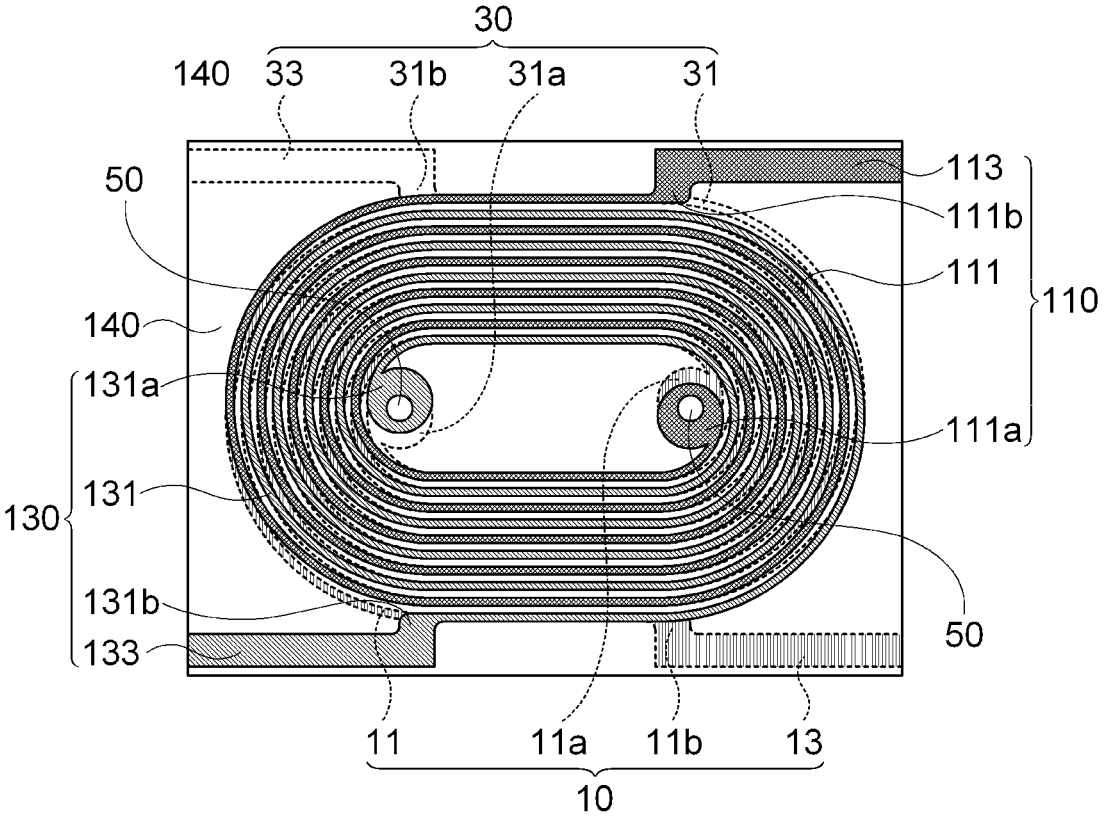
FIG. 2 is a diagram schematically illustrating a common mode filter according to another embodiment of the present invention.
Figure 3:
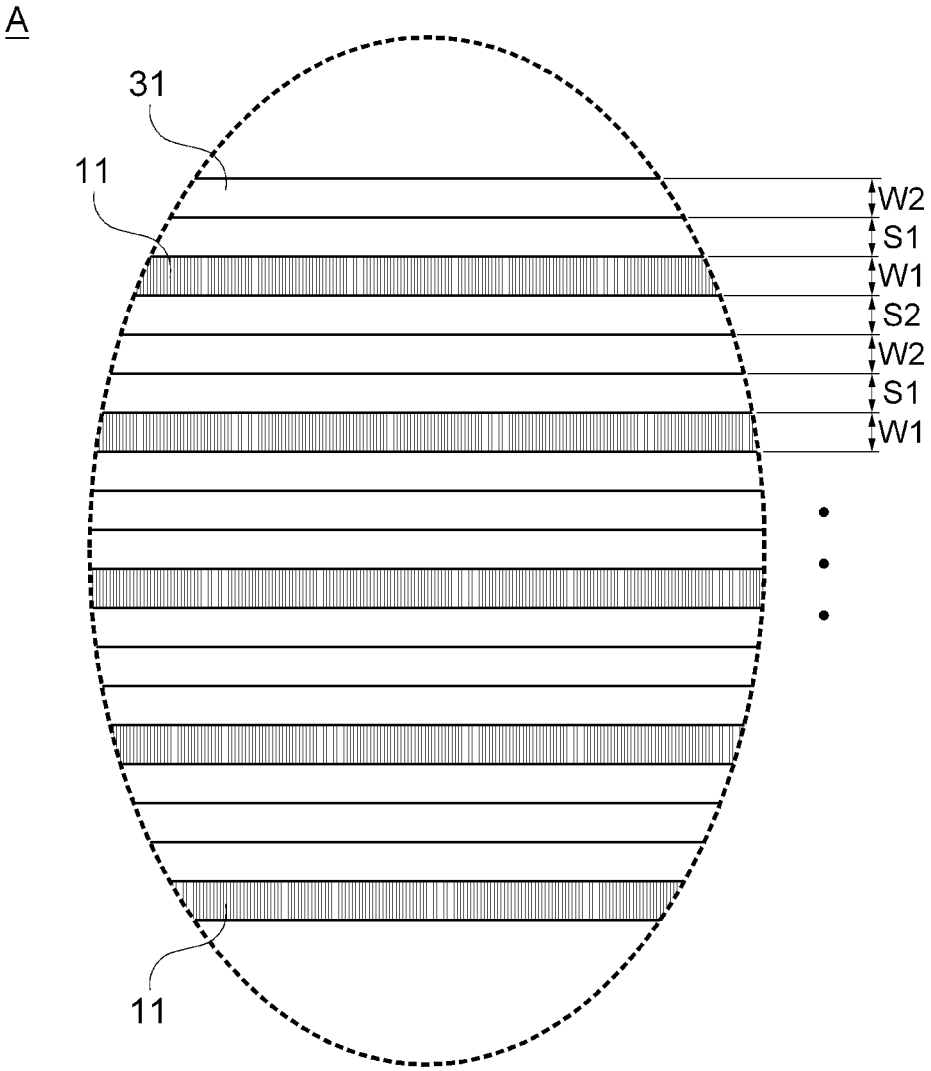
FIG. 3 is an enlarged view of portion 'A' of FIG. 1.
Figure 4A:
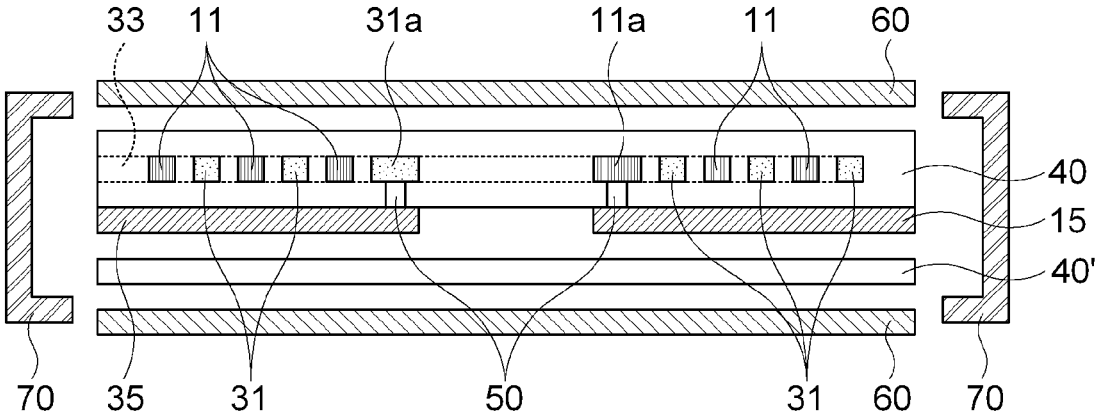
FIG. 4A is a diagram schematically illustrating a common mode filter according to still another embodiment of the present invention.
Figure 4B:
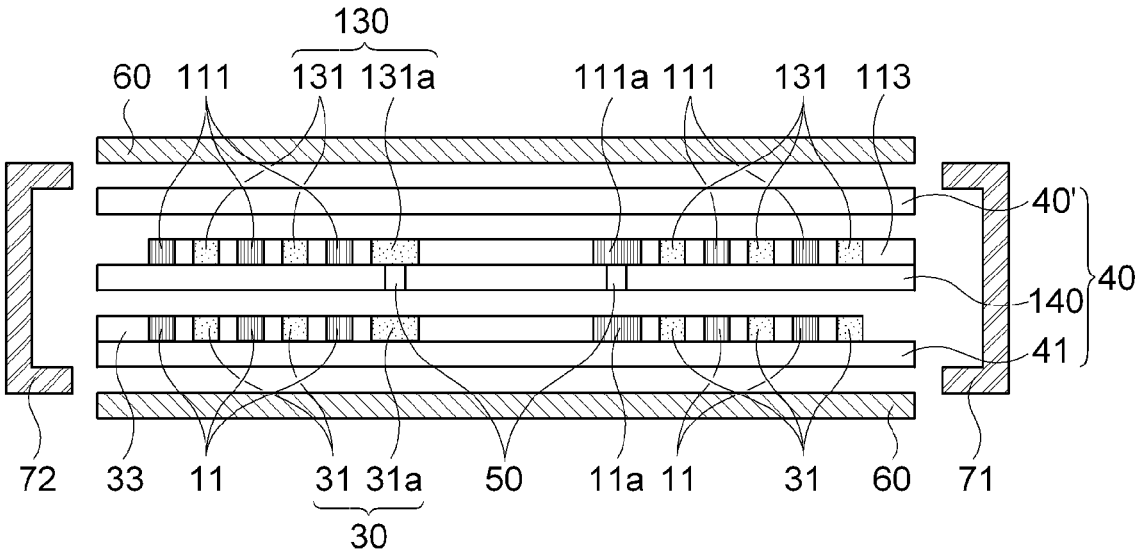
FIG. 4B is a diagram schematically illustrating a common mode filter according to still yet another embodiment of the present invention.
Figure 5A:
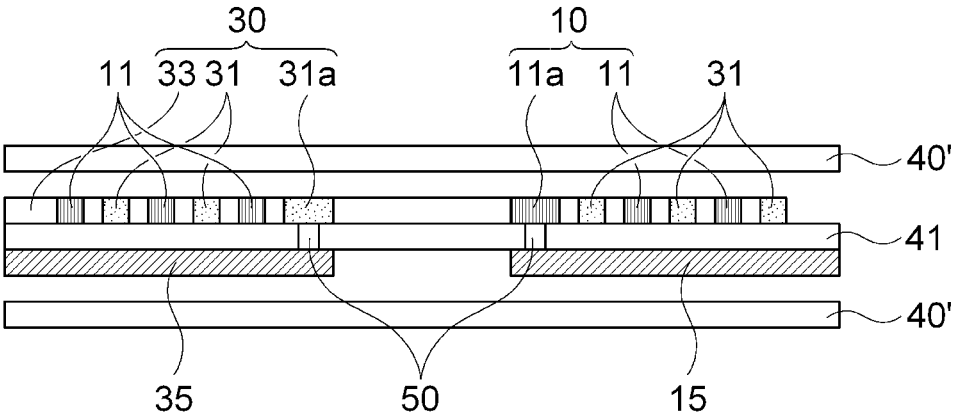
FIGS. 5A to 5C are diagrams schematically illustrating a method of manufacturing a common mode filter according to an exemplary embodiment of the present invention.
Figure 5B:
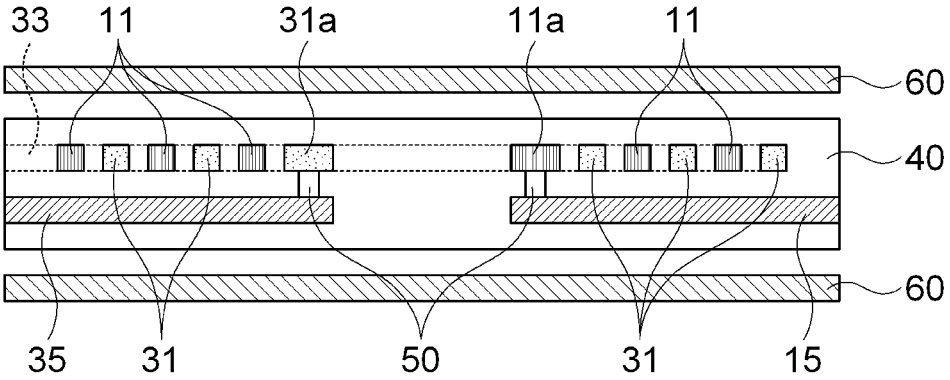
Figure 5C:
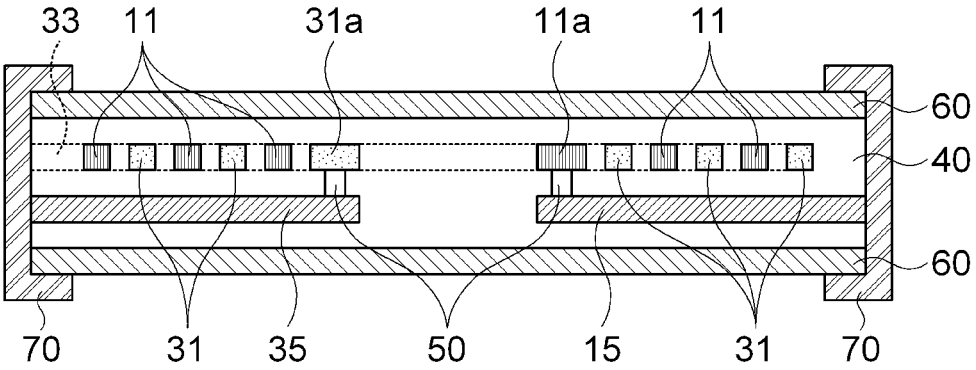
Figure 7:
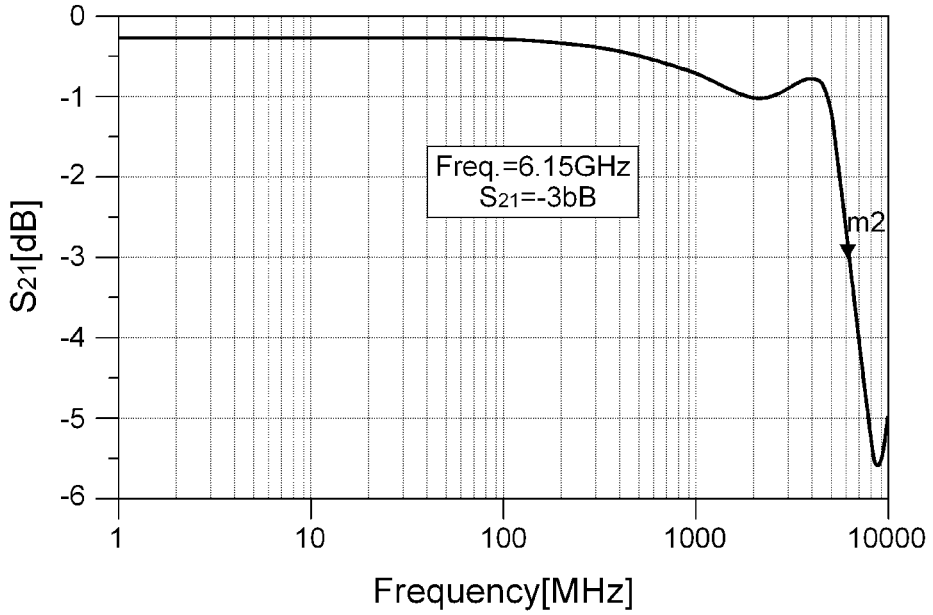
FIG. 7 is a graph schematically illustrating the insertion loss characteristic of the common mode filter according to the exemplary embodiment of the present invention.

FIG. 1 is a diagram schematically illustrating a common mode filter according to an embodiment of the present invention, FIG. 2 is a diagram schematically illustrating a common mode filter according to another embodiment of the present invention, FIG. 3 is an enlarged view of portion 'A' of FIG. 1, FIG. 4A is a diagram schematically illustrating a common mode filter according to still another embodiment of the present invention, FIG. 4B is a diagram schematically illustrating a common mode filter according to still yet another embodiment of the present invention, FIGS. 5A to 5C are diagrams schematically illustrating a method of manufacturing a common mode filter according to an exemplary embodiment of the present invention, and FIG. 7 is a graph schematically illustrating the insertion loss characteristic of the common mode filter according to the exemplary embodiment of the present invention.

Referring to FIGS. 1 and/or 2, a common mode filter according to an embodiment of the present invention may include primary coils 10 and 110 and secondary coils 30 and 130.

The primary coils 10 and 110 of the common mode filter include primary coil bodies 11 and 111 that form a plane in a vortex structure.

Next, the secondary coils 30 and 130 of the common mode filter include secondary coil bodies 31 and 131 that form a co-plane in the same vortex structure as the primary coil bodies 11 and 111. In this case, the secondary coil bodies 31 and 131 have the same length, width, and turn number as the primary coil bodies 11 and 111. Further, the secondary coil bodies 31 and 131 form a 180° rotational symmetry with the primary coil bodies 11 and 111.

The inter-coil impedance matching may be implemented by forming the primary coils 10 and 110 and the secondary coils 30 and 130 on a co-plane in parallel, making the length and the turn number of the coil equal, and forming the primary coils 10 and 110 and forming the secondary coils 30 and 130 so as to be a 180° rotational symmetry with each other so as to increase the electromagnetic degree of coupling, thereby improving an insertion loss characteristic.

Figure 6:
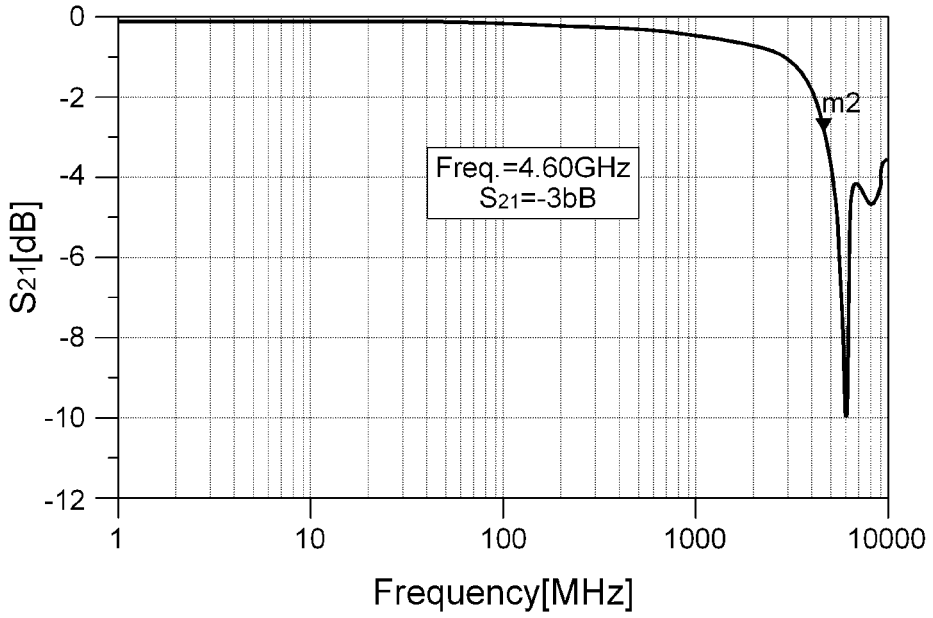
FIG. 6 is a graph schematically illustrating an insertion loss characteristic of the common mode filter according to a comparison example.

FIG. 6 is a simulation result illustrating the insertion loss characteristic of the common mode filter of a set of coil patterns that have the same turn number but a difference of 10% in length and FIG. 7 is a simulation result illustrating the insertion loss characteristic of the common mode filter of the set of the coil patterns having the same turn number and the same length according to the embodiment of the present invention. It can be appreciated from FIG. 6 that the electromagnetic degree of coupling, that is, that is, coil coupling coefficients between two coils due to a difference in a coil length, are reduced to degrade the insertion loss characteristic, while it can be appreciated from FIG. 7 that the insertion loss characteristic is improved in the case of the pattern having the same length. That is, in FIG. 6, a frequency of which the insertion loss S21 is −3 dB is 4.6 GHz, but in FIG. 7, a frequency of which the insertion loss S21 is −3 dB is 6.15 GHz, such that the insertion loss characteristic is improved and thus, a bandwidth is far wider. In this case, FIG. 7 illustrates a case in which a ratio S/(W+S) of an inter-coil distance S to a coil width W+an inter-coil distance S is 0.5.

Referring to FIGS. 1 and/or 2, in one example, a basic shape of a vortex structure of the primary and secondary coil bodies 11 and 31 and 111 and 131 may be a figure in which a half structure of the primary and secondary coil bodies forms a 180° rotational symmetry with each other.

For example, a diagram in which the half structure forms the 180° rotational symmetry ma be any one of an oval, a circle, and a polygon. FIGS. 1 and/or 2 illustrate an oval as a basic figure in which the half structure forms the 180° rotational symmetry, but the basic figure may be substituted into a circle, a rectangle, a diamond, a hexagon, an octagon, and the like.

This will be described in detail with reference to the following Table 1. Table 1 shows a common mode (CM) impedance and a cutoff frequency that is the insertion loss characteristic, according to the ratio of the inter-coil distance S to the coil width W+the inter-coil distance S.

TABLE 1

| Ratio[S/(W + S)] | CM Impedance [Ω] | Cutoff Frequency [GHz] |
|---|---|---|
| 0.08 | 29.15 | 3.59 |
| 0.17 | 29.03 | 3.87 |
| 0.21 | 28.95 | 4.25 |
| 0.25 | 28.84 | 5.57 |
| 0.33 | 28.72 | 5.86 |
| 0.42 | 28.6 | 5.86 |
| 0.5 | 28.4 | 6.15 |
| 0.58 | 28.2 | 6.11 |
| 0.67 | 28 | 5.98 |
| 0.75 | 28.2 | 5.86 |
| 0.79 | 28 | 4.41 |
| 0.89 | 27.8 | 3.92 |
| 0.92 | 27.6 | 3.67 |

In the structure of the primary and secondary coils 10, 30, 110, and 130 that are formed on a co-plane, it can be appreciated that the insertion loss characteristic depends on the coil width W between the patterns and the inter-coil distance S. That is, referring to Table 1, it can be appreciated that the common mode (CM) impedance according to the change in the inter-coil distance has little difference, but the cutoff frequency characteristic representing the insertion loss characteristic is changed. Even though the impedance matching is performed by making the lengths of the primary and secondary coils 10, 30, 110, and 130 equal, when the inter-coil interval is narrow, parasitic capacitance is increased and thus, the insertion loss characteristic is degraded.

In Table 1, it can be appreciated that when the ratio S/(W+S) is reduced from 0.33 to 0.25, the cut off frequency is insignificantly reduced from 5.86 GHz to 5.57 GHz, but when the ratio S/(W+S) is reduced from 0.25 to 0.21, the cutoff frequency is largely changed from 5.57 GHz to 4.25 GHz. Further, it can be appreciated that when the ratio S/(W+S) is increased from 0.67 to 0.75, the cutoff frequency is slightly reduced from 5.98 GHz to 5.86 GHz, but when the ratio S/(W+S) is increased from 0.75 to 0.79, the cutoff frequency is largely reduced from 5.86 GHz TO 4.41 GHz. That is, when the ratio of the inter-coil interval S to the coil width W+the inter-coil interval S is less than 0.25 or exceeds 0.75, it can be appreciated that the insertion loss characteristic (cutoff frequency) is suddenly reduced due to the effect of the parasitic capacitance. The reason why the cutoff frequency is suddenly reduced in spite of the increase in the inter-coil interval when the ratio S/(W+S) is 0.75 or more is that the inter-coil interval is increased at one coil but the inter-coil interval is narrow at the opposite coil, by fixing the primary coil 10 so as to meet the same length within a limited space and horizontally moving the secondary coil 30.

Therefore, in order to improve the insertion loss characteristic at the coil having the same length that is formed on the co-plane, it is important to satisfy the relationship of $0.25 \leq S/(W+S) \leq 0.75$. In this case, S represents an interval between the primary and secondary coil bodies 11 and 31 and 111 and 131 and W represents a width of the primary and secondary coil bodies 11 and 31 and 111 and 131. For example, it can be appreciated from FIG. 3 that S/(W+S) may be S1/(W1+S1), S2/(W2+S2), S2/(W1+S2), or S1/(W2+S1). In this case, W1 represents a width of the primary coil body 11 and W2 represents a width of the secondary coil body 31. The width of the primary coil body 11 and the width of the secondary coil body 31 are the same, such that W1=W2. The inter-coil distances S1 and S2 may be the same.

Further, an example in which the primary and secondary coil bodies 11 and 31 are formed in a single layer and are formed on a single plane will be described with reference to FIGS. 4A and/or 5C. According to one example, the primary coil 10 includes the primary coil body 11, a primary inner connection portion 15, and a primary outer connection portion 13. Further, the secondary coil 30 includes the secondary coil body 31, a secondary inner connection portion 35, and a secondary outer connection portion 33. In this case, the primary inner connection portion 15 of the primary coil 10 is formed on a plane different from the primary coil body 11 and is connected with a vortex inner end 11*a* of the primary coil body 11. In this case, the primary inner connection portion 15 of the primary coil 10 may be connected with the vortex inner end 11*a* of the primary coil body 11 through a via 50. The primary outer connection portion 13 of the primary coil 10 is connected with the other end 11*b* of the primary coil body 11. Further, the secondary inner connection portion 35 of the secondary coil 30 is formed on the co-plane together with the primary inner connection portion 15 of the primary coil 10 and is connected with the vortex inner end 31*a* of the secondary coil body 31. The secondary outer connection portion 33 of the secondary coil 30 is connected with the other end 31*b* of the secondary coil body 31.

Further, referring to FIGS. 4A and/or 5C, in one example, the common mode filter may further include a non-magnetic insulating layer 40, magnetic layers 60, and a plurality of external electrodes 70. In this case, the primary and secondary coils 10 and 30 are embedded in the non-magnetic insulating layer 40. For example, when inner connection portions 15 and 35 are formed beneath the non-magnetic insulating layer 40, a non-magnetic insulating layer 40' may be further laminated so as to cover the inner connection portions 15 and 35. The magnetic layers 60 are formed above and under the non-magnetic insulating layer. Further, the plurality of external electrodes 70 are formed outside a laminate that is formed of the non-magnetic insulating layer 40 and the magnetic layers 60. In this case, the plurality of external electrodes 70 are connected with the outer and inner connection portions 13, 33, 15, and 35 of the primary and secondary coils 10 and 30.

The common mode filter that is laminated of the primary and secondary coil in a multilayer structure will be described with reference to FIGS. 2 and 4B. According to one example, the primary and secondary coils 10, 30, 110, and 130 are laminated in a multilayer structure of at least two layers. In this case, in each layer of the multilayer structure, the primary and secondary coil bodies 11, 31, 111, and 131 form the 180° rotational symmetry. Further, vortex inner ends 11*a* and 111*a* and 31*a* and 131*a* and the other ends 11*b* and 111*b* and 31*b* and 131*b* may be each connected between the primary coil bodies 11 and 111 and the secondary coil bodies 31 and 131 through the vias 50, wherein the primary coil bodies 11 and 111 and the secondary coil bodies 31 and 131 are formed on an upper layer and a lower layer adjacent to each other in the multilayer structure. FIG. 4B illustrates that the inner ends 11*a* and 111*a* and 31*a* and 131*a* are connected with each other through the vias 50. For example, referring to FIGS. 2 and 4B, when the primary and secondary coils 10, 30, 110, and 130 are laminated to have a two-layer structure, the vortex inner ends 11*a* and 11*a* and 31*a* and 131*a* may each connected between the primary coil bodies 11 and 111 and the secondary coil bodies 31 and 131 that are formed on the upper layer and the lower layer through the vias 50. Further, although not illustrated, when the primary and second coils are laminated to have a three-layer structure, the inner ends of the coil bodies are connected at one of two boundary layers through the vias and the other ends of the coil bodies are connected at the rest one through the vias. That is, the inner ends 11*a* and 111*a* and 31*a* and 131*a* and the other ends 11*b* and 111*b* and 31*b* and 131*b* of the coil bodies that are not connected with different adjacent layers are be connected between the primary coil bodies 11 and 111 and the secondary coil bodies 31 and 131, wherein the primary coil bodies 11 and 111 and the secondary coil bodies 31 and 131 are formed on the upper layer and the lower layer adjacent to each other in the multilayer structure.

Next, referring to FIGS. 2 and 4B, in one example, the primary coil bodies 11 and 111 and the secondary coil bodies 31 and 131, which are formed on the upper layer and the lower layer adjacent to each other, have a structure in which the upper and lower layers are a linear symmetry with each other in a plan view. Further, the secondary coil body 31 may be formed under the primary coil body 111 on the upper layer and the primary coil body 11 may be formed under the secondary coil body 131 on the upper layer.

Further, referring to FIG. 4B, according to one example, the common mode filter having the multilayer structure may further include non-magnetic insulating layers 40, 41, 140, and 40', the magnetic layers 60, and a plurality of external electrodes 71 and 72. In this case, the multi-layer structure of the primary and secondary coils is embedded in the non-magnetic insulating layers 40, 41, and 140. Further, the vias 50 that connects between the inter-layer primary coil bodies 11 and 111 and the secondary coil bodies 31 and 131 are embedded in the non-magnetic insulating layer 140. The magnetic layers 60 are formed above and under the non-magnetic insulating layer 40. Further, the plurality of external electrodes 71 and 72 are formed outside the laminate that is formed of the non-magnetic insulating layer 40 and the magnetic layers 60. In this case, the plurality of external electrodes 71 and 72 are connected with connection portions 13 and 133 connected with the rest that are not connected with the ends 11*a*, 111*a*, 31*a*, and 131*a* of the primary and secondary coil bodies of the adjacent layers among the inner ends and the other ends of the primary and secondary coil bodies 11, 31, 111, and 131 that are formed at the outermost layers in the multilayer structure. For example, in the common mode filter having the two-layer structure of the primary and secondary coils, the vortex inner ends 11*a* and 111*a* and 31*a* and 131*a* are connected between the inter-layer primary coil bodies 11 and 111 and secondary coil bodies 31 and 131, such that the connection portions connected with the rest outer ends 11*b* and 111*b* and 31*b* and 131*b* are connected with the plurality of external electrodes 70. Further, in the case of the three-layer structure, the external electrodes may be connected with the connection portions connected with the outer ends of the primary and secondary coil bodies that are formed on one of the outermost layers and the rest external electrodes may be connected with the connection portions connected with the vortex inner ends of the primary and secondary coil bodies formed on the other one of the outermost layers. That is, when N layers are an even layer, the outer connection portions connected with the other ends of the primary and secondary coil bodies on the outermost layer may be connected with the external electrodes, when N layers are an odd layer, in one of the outermost layers, the inner connection portions connected with the vortex inner ends of the primary and secondary coil bodies are connected with a part of the external electrodes, and in the rest layers of the outermost layers, the outer connection portions connected with other ends of the primary and secondary coil bodies may be connected with the rest external electrodes.

Next, a method of manufacturing a common mode filter according to a second exemplary embodiment of the present invention will be described in detail with reference to the accompanying drawings. In this case, in examples of the common mode filter according to the foregoing first exemplary embodiment of the present invention and FIG. 1 to FIG. 4B and FIG. 7 will be referenced and therefore, the overlapping descriptions thereof may be omitted.

FIGS. 5A to 5C are diagrams schematically illustrating a method of manufacturing a common mode filter according to an exemplary embodiment of the present invention.

Referring to FIGS. 5A to 5C, the method of manufacturing a common mode filter according to one example includes forming the primary and secondary coils 10 patterns so that the primary and secondary coils 10 patterns are formed on the co-plane and form the 180° rotational symmetry with each other. In this case, the primary coil 10 pattern includes the primary coil body 11 having the vortex structure. Further, the secondary coil 30 pattern includes the secondary coil body 31 that has the same length, width, and turn number so as to have the same vortex structure as the primary coil body 11.

In this case, referring to the foregoing Table 1, in one example, the primary and secondary coil patterns may be formed so as to meet $0.25 \leq S/(W+S) \leq 0.75$ when the interval between the primary and secondary coil bodies is S and the width of the primary and secondary coil bodies is W.

Describing one example in which the primary and secondary coils 10 and 30 patterns are formed in a single layer structure with reference to FIGS. 5A to 5C, the method of manufacturing a common mode filter may further include forming a non-magnetic insulating layer on which the primary and secondary coils 10 and 30 patterns are embedded (see FIG. 5A), forming the laminate (see FIG. 5B), and forming the external electrode (see FIG. 5C).

Referring first to FIG. 5A, in the forming of the non-magnetic insulating layer in which the primary and secondary coils 10 and 30 patterns are embedded, the upper non-magnetic insulating layer 40' is laminated on the lower non-magnetic insulating layer 41 on which the primary and secondary coils 10 and 30 patterns are formed. Further, in the forming of the non-magnetic insulating layer in which the primary and secondary coils 10 and 30 patterns are embedded, the inner connection portions 15 and 35 that are connected with the inner connection portions 15 and 35 connected with the vias 50 connected with the vortex inner ends 13 and 33 of the primary and secondary coil bodies 11 and 31 by penetrating through the lower or upper non-magnetic insulating layers 41 and 40' are formed on the lower or upper non-magnetic insulating layer 41 and 40'. In this case, after the lower non-magnetic insulating layer 40 in which the vias 50 are formed is prepared, the primary and secondary coils 10 and 30 patterns may be formed on the lower non-magnetic insulating layer 41 and the upper non-magnetic insulating layer 40' may be formed thereon. Alternatively, as another method, the primary and secondary coils 10 and 30 patterns may be formed on the lower non-magnetic insulating layer 41, the upper non-magnetic insulating layer 40 may be formed thereon, and then, the vias 50 may also be formed on the lower or upper non-magnetic insulating layers 41 and 40'. Further, the inner connection portions 15 and 35 connected with the vias 50 may be formed in the preparing of the non-magnetic insulating layer 40 on which the vias 50 are formed, formed in the forming the primary and secondary coils 10 and 30 patterns after the vias 50 are formed, or formed after the primary and secondary coils 10 and 30 patterns are formed and the upper non-magnetic insulating layer 40' is laminated. The middle portion of FIG. 5A illustrates that the vias 50 are formed on the lower non-magnetic insulating layer 41 in which the primary and secondary coils 10 and 30 patterns are formed and the inner connection portions 15 and 35 are formed under the lower non-magnetic insulating layer 41. Further, as illustrated in FIG. 5A, the non-magnetic insulating layer 40' may be added between the lower non-magnetic insulating layer 41 in which the inner connection portions 15 and 35 are formed and the magnetic layer 60 to be laminated at the following step.

Next, referring to FIG. 5B, in the forming of the laminate, the laminate is formed by laminating the magnetic layers 60 above and under the non-magnetic insulating layer 40, respectively. In this case, the magnetic layer 60 may be formed of an insulating material.

Next, referring to FIG. 5C, in the forming of the external electrode, the outer connection portions 33 connected with the other ends 15 and 35 of the primary and secondary coil bodies 11 and 31 and the plurality of external electrodes 70 connected with the inner connection portions 15 and 35 are formed outside the laminate.

Although not illustrated, one example in which the primary and secondary coil patterns are formed in the multilayer structure will be described with reference to FIGS. 5A to 5C and FIG. 4B. In this case, the method of manufacturing a common mode filter may further include forming the multilayer, forming the non-magnetic laminated insulating layers in which the primary and secondary coil patterns having the N layer structure are embedded, forming the laminate, and forming the external electrode.

In this case, in the forming of the multilayer, the forming of an N-th layer is repeatedly laminated N−1 times according to the increase in N when N is a natural number of 2 or more. That is, when N is 2, the forming of a second layer is performed once so as to be laminated, when N is 3, the forming of the second layer and the forming of the third layer are performed and laminated, when N is 4, the forming of the second layer, the forming of the third layer, and the forming of the fourth layer are performed and laminated. In this case, the forming of the N-th layer includes laminating an N-th non-magnetic insulating layer and forming the primary and secondary coil patterns on the N-th layer.

Describing in detail reference numeral 140 of FIG. 4B, the patterns and the vias on reference numeral 140, and FIG. 5A together, in the laminating of the N-th non-magnetic insulating layer, the primary and secondary coil patterns on an N−1-th layer are formed on the N−1-th non-magnetic insulating layer and then, the N-th non-magnetic insulating layer is laminated on the primary and secondary coil patterns. In this case, in the forming of the primary and secondary coil patterns on the N-th layer, the primary and secondary coil patterns on the N-th layer connected with ends of the primary and secondary coil patterns on the N−1-th layer through the vias connected with ends of the primary and secondary coil patterns on the N−1-th layer by penetrating through the N-th non-magnetic insulating layer and the vias of the N-th non-magnetic insulating layer are formed on the N-th non-magnetic insulating layer. In this case, after the N-th non-magnetic insulating layer is laminated, the vias of the N-th non-magnetic insulating layer and the primary and secondary coil patterns on the N-th layer are formed or the N-th non-magnetic insulating layer on which the vias of the N-th non-magnetic insulating layer and the primary and secondary coil patterns on the N-th layer are formed may also be laminated on the primary and secondary coil patterns on the N−1-th layer. In this case, ends at which the primary and secondary coil patterns on the upper and lower layers are connected with each other through the vias are the rest ends at which the primary and secondary coil patterns on another layer are not connected with each other when N−1 is 2 or more. That is, when N is 3 or more, in the forming of the second layer (see FIG. 4B), the vortex inner ends 11*a* and 111*a* and 31*a* and 131*a* having the primary and secondary coils 10, 30, 110, and 130 patterns of the first layer and the second layer are connected with each other and in the forming of the third layer (not illustrated), the other ends having the primary and secondary coil patterns of the second layer and the third layer are connected with each other. When N is 4, in the forming of the fourth layer, the vortex inner ends having the primary and secondary coil patterns on the third layer and the fourth layer are connected with each other.

Next, referring to reference numeral 40' in FIG. 4B, in the forming of the non-magnetic laminated insulating layer in which the primary and secondary coil patterns having the N-layer structure are embedded, the N+1-th non-magnetic insulating layer is laminated on the primary and secondary coil patterns on the top N-th layer formed in the forming of the multilayer to form the non-magnetic laminated insulating layer in which the primary and secondary coil patterns having the N-layer structure are embedded.

Next, referring to reference numeral 60 of FIGS. 5B and 4B together, in the forming of the laminate, the laminate is formed by laminating the magnetic layer 60 above and under the non-magnetic laminated insulating layer, respectively.

Next, referring to reference numerals 71 and 72 of FIGS. 5C and 4B together, in the forming of the external electrode, the plurality of external electrodes 70 that are connected with the connection portions connected with the rest that are not connected with ends of the primary and secondary coil bodies of the adjacent layers among the vortex inner ends and the other ends of the primary and secondary coil bodies formed on the outermost layer having the N-layer structure are formed outside the laminate. For example, when N is 2, the vortex inner ends 11*a* and 111*a* and 31*a* and 131*a* of the primary and secondary coil bodies 11 and 31 and 111 and 131 on the upper and lower layers are connected with each other via the vias 50 and the plurality of external electrodes 71 and 72 are connected with the outer connection portions 33 and 113 connected with the other rest ends (see 11*b*, 111*b*, 31*b*, and 131*b* of FIG. 2). When N is 3, some of the external electrodes are connected with the inner connection portions that are connected with the vortex inner ends of the primary and secondary coil bodies on one of the outermost layers and the rest external electrodes are connected with the outer connection portion that are connected with the other ends of the primary and secondary coil bodies of the rest layers among the outermost layers. That is, when N layers are an even layer, the outer connection portions connected with the other ends of the primary and secondary coil bodies on the outermost layer may be connected with the external electrodes, when N layers are an odd layer, in one of the outermost layers, the inner connection portions connected with the vortex inner ends of the primary and secondary coil bodies are connected with a part of the external electrodes, and in the rest layers of the outermost layers, the outer connection portions connected with other ends of the primary and secondary coil bodies may be connected with the rest external electrodes.

According to the exemplary embodiments of the present invention, the electromagnetic degree of coupling can be increased by forming the primary coil and the secondary coil on a co-plane in parallel, making the length and the turn number of the coil equal, and forming the primary coil and the secondary coil so as to be 180° rotational symmetry with each other, thereby improving the insertion loss characteristic.

Further, according to the exemplary embodiments of the present invention, the insertion loss characteristic can be improved by improving the ratio of the inter-coil distance to the sum of the coil width between the patterns and the inter-coil distance.

The accompanying drawings and the above-mentioned exemplary embodiments have been illustratively provided in order to assist in understanding of those skilled in the art to which the present invention pertains rather than limiting a scope of the present invention. In addition, exemplary embodiments according to a combination of the above-mentioned configurations may be obviously implemented by those skilled in the art. Therefore, various exemplary embodiments of the present invention may be implemented in modified forms without departing from an essential feature of the present invention. In addition, a scope of the present invention should be interpreted according to claims and includes various modifications, alterations, and equivalences made by those skilled in the art.

What is claimed is:

1. A common mode filter, comprising:

a primary coil that includes a primary coil body forming a plane in a vortex structure; and a secondary coil that includes a secondary coil body forming a co-plane in the same vortex structure as the primary coil body and forms a 180° rotational symmetry with the primary coil body, having the same length, width, and turn number as the primary coil body; and wherein when an interval between the primary and secondary coil bodies is S and the width of the primary and secondary coil bodies is W, the primary and secondary coil patterns are formed so as to meet $0.25 \leq S/(W+S) \leq 0.75$.

2. The common mode filter according to claim 1, wherein a basic shape of the vortex structure of the primary and secondary coil bodies is a shape of a figure having a half structure in which the primary and secondary coil bodies form the 180° rotational symmetry with each other.

3. The common mode filter according to claim 2, wherein the figure in which the half structure forms the 180° rotational symmetry is any one of an oval, a circle, and a polygon.

4. The common mode filter of claim 1, wherein the primary coil is formed on a plane different from the primary coil body and further includes a primary inner connection portion that is connected with a vortex inner end of the primary coil body and a primary outer connection portion that is connected with the other end of the primary coil body, and the secondary coil is formed on the same plane as the primary inner connection portion and further includes a secondary inner connection portion that is connected with a vortex inner end of the secondary coil body and a secondary outer connection portion that is connected with the other end of the secondary coil body.

5. The common mode filter according to claim 4, further comprising:

a non-magnetic insulating layer in which the primary and secondary coils are embedded;

magnetic layers formed above and under the non-magnetic insulating layer; and a plurality of external electrodes that are formed outside a laminate of the insulating layer and the magnetic layers and connected with the outer and inner connection portions of the primary and secondary coils.

6. The common mode filter of claim 1, wherein the primary and secondary coils are laminated in a multilayer structure of at least two layers, the primary and secondary coil bodies form the 180° rotational symmetry in each layer of the multilayer structure, and the vortex inner ends or the other ends are each connected between the primary coil bodies and the secondary coil bodies on an upper layer and a lower layer adjacent to each other in the multilayer structure through vias.

7. The common mode filter according to claim 6, wherein the primary coil bodies and the secondary coil bodies on the upper and lower layers adjacent to each other have upper and lower structures forming a linear symmetry in a plan view, and the second coil body is formed under the primary coil body on the upper layer and the primary coil body is formed under the secondary coil body on the upper layer.

8. The common mode filter according to claim 6, further comprising:

a non-magnetic insulating layer in which the multilayer structure of the primary and secondary coils and the vias are embedded;

magnetic layers formed above and under the non-magnetic insulating layer; and a plurality of external electrodes that are formed outside a laminate of the insulating layer and the magnetic layers and are connected with connection portions connected with the rest not connected with the ends of the primary and secondary coil bodies on the adjacent layers among the inner and other ends of the primary and secondary coil bodies formed on an outermost layer in the multilayer structure.

9. A method of manufacturing a common mode filter, comprising:

forming a primary coil pattern including a primary coil body having a vortex structure and a secondary coil pattern including a secondary coil body having the same vortex structure as the primary coil body and having the same length, width, and turn number as the primary coil body and forming the primary and secondary coil patterns so that the primary and secondary coil patterns form the same plane and has a 180° rotational symmetry with each other; and wherein when an interval between the primary and secondary coil bodies is S and the width of the primary and secondary coil bodies is W, the primary and secondary coil patterns are formed so as to meet $0.25 \leq S/(W+S) \leq 0.75$.

10. The method according to claim 9, further comprising:

laminating an upper non-magnetic insulating layer on a lower non-magnetic insulating layer on which the primary and secondary coil patterns are formed and forming inner connection portions connected with the vias connected with the vertex inner ends of the primary and secondary coil bodies by penetrating through the lower or upper non-magnetic insulating layer on the lower or upper non-magnetic insulating layer to form a non-magnetic insulating layer in which the primary and secondary coil patterns are embedded;

forming a laminate by laminating a magnetic layer above and under the non-magnetic insulating layer; and forming outer connection portions connected with the other ends of the primary and secondary coil bodies and a plurality of external electrodes connected with the inner connection portions outside the laminate.

11. The method according to claim 9, further comprising:

forming the primary and secondary coil patterns on a N−1-th layer on a N−1-th non-magnetic insulating layer and then, laminating a N-th non-magnetic insulating layer on the primary and secondary coil patterns, wherein when the N−1 is 2 or more, the vias are connected with the rest ends that are not connected with primary and secondary coil patterns on the other layer and forming a multilayer repeatedly forming an N-th layer N−1 times in which vias connected with ends of the primary and secondary coil patterns on the N−1-th layer by penetrating through the N-th non-magnetic insulating layer and the primary and secondary coil patterns on a N-th-layer connected with ends of the primary and secondary coil patterns on the N−1-th layer through the vias are formed on the N-th non-magnetic insulating layer, when the N is a natural number of 2 or more;

laminating a N+1-th non-magnetic insulating layer on the primary and secondary coil patterns on the top N-th layer formed in the forming of the multilayer to form a non-magnetic laminated insulating layer in which the primary and secondary coil patterns having the N-layer structure are embedded;

forming a laminate by laminating a magnetic layer above and under the non-magnetic layered insulating layer, respectively; and forming the plurality of external electrodes connected with connection portions connected with the rest that are not connected with ends of the primary and secondary coil bodies of the adjacent layers among the vortex inner ends and the other ends of the primary and secondary coil bodies formed on an outermost layer having the N-layer structure outside the laminate.

* * * * *